US005440818A

United States Patent [19]

Mailhot

[11] Patent Number: 5,440,818

[45] Date of Patent: Aug. 15, 1995

[54] VERSATILE MEASURING DEVICE

[76] Inventor: Walter L. Mailhot, 70 Main St., Plaistow, N.H. 03865

[21] Appl. No.: 173,186

[22] Filed: Dec. 23, 1993

[51] Int. Cl.[6] ..... B43L 7/10

[52] U.S. Cl. ..... 33/452; 33/464; 33/462

[58] Field of Search ..... 33/416, 417, 418, 419, 33/424, 425, 426, 427, 451, 452, 456, 458, 459, 460, 461, 462, 463, 464, 465, 468, 469, 470, 471, 484, 485, 526, 534, 29, 42, 474, 478

[56] References Cited

U.S. PATENT DOCUMENTS

| | | | |
|---|---|---|---|
| 185,504 | 12/1876 | Devoe | 33/461 |
| 503,050 | 8/1893 | Lantz | 33/474 |
| 847,720 | 3/1907 | Barbo | 33/462 |
| 1,205,687 | 11/1916 | Verhey et al. | 33/462 |
| 1,601,138 | 9/1926 | Moore | 33/462 |
| 1,622,158 | 3/1927 | Liberty | 33/462 |
| 2,887,775 | 5/1959 | Ross | 33/459 |
| 3,991,474 | 11/1976 | Rath | 33/462 |
| 4,451,993 | 6/1984 | Yauk | 33/464 |
| 4,955,141 | 9/1990 | Welch | 33/451 |
| 5,205,045 | 4/1993 | Liu | 33/426 |

FOREIGN PATENT DOCUMENTS

| | | | |
|---|---|---|---|
| 421950 | 4/1924 | Germany | 33/426 |

*Primary Examiner*—William A. Cuchlinski, Jr.
*Assistant Examiner*—G. Bradley Bennett
*Attorney, Agent, or Firm*—George W. Dishong

[57] ABSTRACT

An improved versatile measuring device for measuring linear, and angular dimensions and defining relative positional parameters or coordinates between a plurality of lines, points, or surfaces on a plane and for determining and duplicating line lengths and relative angular positions of any number of lines, points or surfaces. The measuring device has protractor members each of which is rotatably and clampably attached to a connecting member which itself is linearly extendible and may also be altered to have a pivoting point about which a main arm and an extendible arm of the connecting member are pivotal and clampable with respect to each other. Each of the protractor ends also has an edge-guide slot substantially parallel to a scribe edge. Slideably mountable onto each of the edge-guide slots is at least one edge-guide pin each of which is positionally adjustable and securable within an edge-guide slot. The pins provide an edge reference useful for the repeated and consistent layout and marking of an article such as stair stringers or roof rafters which are being prepared for use.

12 Claims, 4 Drawing Sheets

VERSATILE MEASURING DEVICE

BACKGROUND OF THE INVENTION

1. Field of the Invention

The invention most generally relates to measuring devices which will measure linear and angular measurements and which devices are useful for the layout of typically construction items which require repeatable accuracy of dimensions and repeatable location of points lines and planes relative to reference points, lines and planes. More particularly, the present invention provides a novel means for pivotably and adjustably connecting a pair of protractor members which may be used primarily within the field of construction.

This invention relates to improvements in geometrical instruments, having for an object to provide a combined straight edge, measuring device and adjustable angle, especially advantageous for use in the measuring of lumber or other material and "laying out" thereon markings which are indicative of the proper measurements and angles at which such material is to be cut.

This invention further relates to improvements in stair and roofing squares, and has particular reference to a device for determining the proper cutting angle for laying out rafters, stairs, hoppers and other angular cuts. The device may also be used for constructing hips or valleys as well as ridges of roofs of buildings.

The invention provides an indispensable device which will occupy a minimum amount of space in a tool box, a device that is economical to manufacture, and one that is easy to use.

2. Description of the Prior Art

None of the known previous related inventions presently provide for the novel and unobvious combination of pivotably connected protractor ends, an extendible central connecting member, edge-guide pins and means for clamping in place the various components so as to form a device capable of easily and rapidly determining stair tread and riser angles or roofing rafter angles and many other construction and lay-out problems and to scribe prior to cutting the lumber.

As indicated above, presently there is nothing available that provides for the pivotably adjustable protractor ends. It would be advantageous to have an improved versatile measuring device device which would be easy to use, simple and reliable. It would also be advantageous to have an extendible connecting member which is capable of forming different sizes and which could be used to create various angles particularly between the protractor members of the measuring device.

Some inventions related to the instant invention and disclosed in the following United States Patents have been studied. The following is a brief description and discussion of patents defining the most closely related inventions.

Alfred A. Hurt, MULTI-PURPOSE SQUARE, U.S. Pat. No. 4,348,815 teaches a pair of first and second elongated arms are provided and the arms include corresponding base and free ends. Pivot structure is provided and pivotably connects the base ends of the arms together for relative 360° angular displacement and the pivot structure and second arm include coacting structure whereby the axis of relative pivoting of the first and second arms may be adjustably shifted along the second arm.

J. D. Murvine, STAIR GAGE, U.S. Pat. No. 1,261,596 teaches an improved gage embodying a pair of adjustably connected adjustable members through the medium of which a mechanic or carpenter may by placing the device on the stringers of the stairway and adjusting the members against the skirting boards to obtain the length and cut of both the tread and riser portions of the stairway in one operation, thus providing an improved labor saving device.

Percy H. Atherley, ROOFING SQUARE, U.S. Pat. No. 2,193,793 teaches improvements in roofing squares, and has particular reference to a device for determining the proper cutting angle for laying out rafters, stairs, hoppers and other angular cuts. The device may also be used for constructing hips or valleys as well as roof ridges.

Sidney Owen, FRAMING TOOL AND BEVEL PROTRACTOR, U.S. Pat. No. 1,616,820 teaches a framing tool, and bevel protractor, and has for its principal object to provide a structure which is efficient in enabling one to obtain the angle of bevel for each end and at the same time obtain the length of any brace, rafter, purline, beam, strut, or the like, by adjusting the tool to the actual position of the proposed brace, etc. then transferring the tool to the stick from which the brace, etc. is to be cut by placing the tool on the stick and scribing, or marking across the ends.

Joseph Liberty, GEOMETRICAL INSTRUMENT, U.S. Pat. No. 1,622,158 teaches and relates to improvements in geometrical instruments, having for an object to provide a combined straight edge, measuring device and adjustable angle, especially advantageous for use in the measuring of lumber or other material and "laying out" thereon marking indicative of the proper measurements and angles at which such material is to be cut.

David Moore, CARPENTER'S SCRIBING GAUGE, U.S. Pat. No. 1,601,138 teaches a so-called scribing gauge which consists mainly of an extensible body carrying scribing plates and protractor heads at the ends for numerous uses in carpentry, among which cutting stair threads, fitting shelves and baseboards, etc..

Oskar Schubert, JOINT MEASURING SCALE, U.S. Pat. No. 597,330 teaches joint-measuring scales of the common type which adapt the measuring scale for use as a scale for determining angles.

Merle T. Sanders, TREAD AND RISER MARKER, U.S. Pat. No. 1,563,229 teaches and relates to measuring instruments and more particularly to gages for use in determining the correct length and angle of stair treads and risers.

Frank J . Ryan, STAIR-BUILDER'S SQUARE, U.S. Pat. No. 1,489,789 teaches and relates to an improved stair builder's square of the type involving a geometrical instrument which is longitudinally adjustable and extensible and provided with opposed straight edges or blades at its ends having a sliding pivotal connection with the body of the implement.

George F. Thielman, STAIR-RULE, U.S. Pat. No. 1,349,348 teaches a rule by means of which the carpenter can easily ascertain the exact distance between the opposite faces of any portion of the stringers or rails and then placing the rule on a piece of lumber can cut it to exactly fit the space.

Uriel Sedgwick Manges, CARPENTER'S GAGE, U.S. Pat. No. 933,655 teaches and relates to carpenter's gages, the object in view being to provide a gage especially designed to enable a carpenter to obtain the correct or exact length and cut or bevel on the ends of the treads and risers of stairways, the device, embodying in connection with a main yoke, which is longitudinally extensible, end gage members which have a jointed connecting with the yoke, means for clamping and bracing the end gages relatively to the yoke for holding the several parts of the gage as a whole in fixed relation to each other after the desired adjustment has been effected.

Purley L. Reeder, COMBINED PITCH-GAGE, U.S. Pat. No. 1,269,509 teaches a new and improved carpenter's tool in the form of a gage, the principal object thereof being to enable the operator to ascertain almost instantaneously the correct angle at which a rafter used in the construction of a roof is to be cut (including the top and the base cut) and likewise the angle at which the jack rafters are to be cut; the result being accomplished by simply setting the several parts of the tool according to the rise of the rafters per foot.

Joseph B. Eliason, DISTANCE AND ANGLE MEASURING DEVICE, U.S. Pat. No. 2,647,322 teaches and relates to measuring instruments and more particularly to instruments or tools for use in measuring distances between and the relative angles of two space structural portions. It is of particular advantage in connection with various types of carpentry such as in the building of stairways, where the exact length and the angle of the ends of the treads and risers should be determined in order to make the parts fit properly. It is a tool which not only will work with accuracy but will greatly reduce the time required by the carpenter in measuring and fitting such parts.

Christ A . Christianson, STAIR SQUARE, U.S. Pat. No. 1,624,535 teaches and relates to a stair square which may be used to obtain the length, treads, and rises between the walls and stair stringers, and in building circular stairs, it may be used as a bevel square at both ends. The device is further useful in obtaining the length and miter cut of bannisters between the top and bottom rails.

Herbert C. Crawford, TREAD AND RISER GAUGE, U.S. Pat. No. 3,242,580 teaches and relates to carpenter's tools and more particularly to an improved gauge device for use in the construction of stairs, shelving and the like.

It is important to first note that none of the prior art known to the inventor hereof, teaches in any manner, the invention herein disclosed and claimed.

Clearly the instant invention provides many advantages over the prior art inventions noted above. The improved and versatile measuring device of the instant invention is capable of being used to mark-off or lay-out with consistent and repeatable accuracy pieces of work such as wooden pieces for use in construction of roofs, stairs of any form, railings and bannisters, each and any of which have uncommon relative angles or distances and is useful is scribing consistent sections for cut-out. The instant device has the capability of linear adjustments, rotational adjustments at each of the protractor ends and separate pivotal adjustment of the member connecting the protractor ends. Additionally, with the use of positionally adjustable edge-guide pins adjustable and securable within a guide slot in each of the protractor ends stops or guides may be set which provides an even further control of another dimension variable.

None of the prior art meets the objects of providing for a protractor rotatably connected at each of the ends connected by means of a central connection member which is lengthwise extendible and pivotable at a selectable pivot location. The combination of the rotatable protractor ends and the central connection member along with the positionally adjustable edge-guide pins, positionally securable within edge-guide pin guide slots in each of the protractor ends, permits a user to rapidly and easily form any ordinarily used size or angle necessary to scribe or mark off the rise and the run on the stair stringers while building stairs or for "laying out" a number of roofing rafters to be cut to fit at the ridge and onto the walls.

Various forms of squares including relatively pivotal arm portions heretofore have been provided in the art. In addition, variations of these squares are provided with spirit levels and many include structure whereby the arms may be releasably secured in adjusted angularly displaced positions.

SUMMARY OF THE INVENTION

The instant invention i s simply an improved versatile measuring device for measuring linear, and angular dimensions and defining relative positional parameters or coordinates between a plurality of lines, points, or surfaces on a plane and for determining and duplicating line lengths and relative angular positions of any number of lines, points or surfaces. The measuring device has protractor members each of which is rotatably and clampably attached to a connecting member which itself is linearly extendible and may also be altered to have a pivoting point about which a main arm and an extendible arm of the connecting member are pivotal and clampable with respect to each other. Each of the protractor ends also has an edge-guide slot substantially parallel to a scribe edge. Slideably mountable onto each of the edge-guide slots is at least one edge-guide pin each of which is positionally adjustable and securable within an edge-guide slot. The pins provide an edge reference useful for the repeated and consistent layout and marking of an article such as stair stringers or roof rafters which are being prepared for use.

A primary object of the invention is to provide an improved versatile measuring device for measuring linear, and angular dimensions comprising: a connecting member which itself comprises; means for rotatably and clampably connecting a protractor member at a protractor connection point at each connecting member end, means for linearly adjusting, to a preselected value, a distance between each said protractor connection points; and at least two protractor members each having a scribe edge at least one of the at least two being rotatably and clampably attached to each of the protractor connection points of the connecting member.

Another primary object of the invention is to provide the improved versatile measuring device as above described wherein the connecting member further comprises a main arm and an extendible arm and the means for linearly adjusting, to a preselected value, a distance between each of the protractor connection points comprises an elongated wall defining a connecting member adjustment slot through the extendible arm, at least two pin assemblies for allowing a slideable relation between the main arm and the extendible arm and for lockingly interengaging the main arm and the extendible arm when a predetermined distance between each of the protractor connection point is achieved.

Yet another primary object of the invention is to provide the improved versatile measuring device as above described further comprising means for removing all but one of the at least two pin assemblies thereby creating a pivoting point about which the main arm and the extendible arm of the connecting member are pivotable and clampable each with respect the other.

Yet still another primary object of the invention is to provide the improved versatile measuring device as above described wherein the at least two protractor members each further comprises means for adjustably positioning and securing an edge-guide pin at a predetermined position along the scribe edge of each of the protractor members.

A further object of the invention is to provide the improved versatile measuring device as above described wherein the at least two protractor members each further comprises at least one side edge having an angle of 45 degrees from the scribe edge of the protractor members.

A still further object of the invention is to provide the improved versatile measuring device as above described wherein the connecting member further comprises a leveling means operative to measure level in a horizontal and a vertical plane.

A yet still further object of the invention is to provide a kit of components which when assembled is an improved versatile measuring device for measuring linear, and angular dimensions. The kit of components comprising: at least two protractor members each having a scribe edge; at least one connecting member having a predetermined length and a first protractor connection end being rotatably and clampably attachable to each of the at least two protractor members and a second protractor connection end rotatably and clampably attachable to each of the at least two protractor members at a protractor connection point; means for linearly adjusting, to a preselected value, a distance between each of the protractor connection points; means for rotatably and clampably attaching each of the at least two protractor members to the protractor connection points of the connecting member; and positionally adjustable edge-guide pins positionally securable within edge-guide pin slots defined by walls substantially parallel to each said scribe edge.

Yet another further object of the invention is to provide the kit of components as described above wherein the connecting member further comprises a main arm and an extendible arm and the means for linearly adjusting, to a preselected value, a distance between each of the protractor connection point comprises an elongated wall defining a connecting member adjustment slot through the extendible arm, at least two pin assemblies for allowing a slideable relation between the main arm and the extendible arm and for making the main arm and the extendible arm lockingly interengagable when a predetermined distance between each of the protractor connection point is determined. The kit of components may also have a means for leveling and plumbing appropriately mountable on the connecting member.

These and further objects of the invention will become apparent to those skilled in the relevant art and after a study of the present disclosure of the invention.

DESCRIPTION OF THE PREFERRED EMBODIMENTS

The following is a description of the preferred embodiment of the improved versatile measuring device of the invention. It is clear that there may be variations in the size and the shape of the device, in the materials used in the construction and in the orientation of some of the components of the improved versatile measuring device. The device could clearly be scaled in many ways; the connecting member shortened or lengthened; the protractor members could be made larger or smaller relative to the size of the connecting member; means for providing for the extendible and pivotable nature of the connecting member could vary from the simple slotted and knob operated clamps; the values of the angles at the side edges of the protractors could vary from for example 20 degrees to near 180 degrees as measured from the scribe or linear scaled edge of the protractors. Having one side edge, the same side edge for each of two protractors, be 45 degrees permits the creation of a 90 degree angle between each of the scribe edges of the two protractors when they are positioned with the 45 degree angled side edges butted together. This feature could also be obtained where the sum of the angles of one of the side edges of one protractor and the side edge of the other protractor, which will abut the first protractor, total 90 degrees.

However, the main features of the improved versatile measuring device are consistent and are, among other features; low cost but durable, an easy to use and uncomplicated measuring device, easily assembled and disassembled for ease of transport and storage, extremely versatile in that an almost limitless variety of angles and linear dimensions may be measured between points, lines or planes and repeated for use in a variety of layouts where consistent repetition is essential such as for example the marking of stair stringers—roof rafters—siding boards and the like and a leveling means may be provided for measuring the degree of level in a horizontal or vertical plane with the device oriented with the protractors horizontally or vertically opposed.

Clearly, because of the ease of assembly and disassembly of the device, a kit of components of varying sizes for varying applications could be provided. The kit would have various sized and shaped protractor members as well as varying length connecting members.

Figure 1:
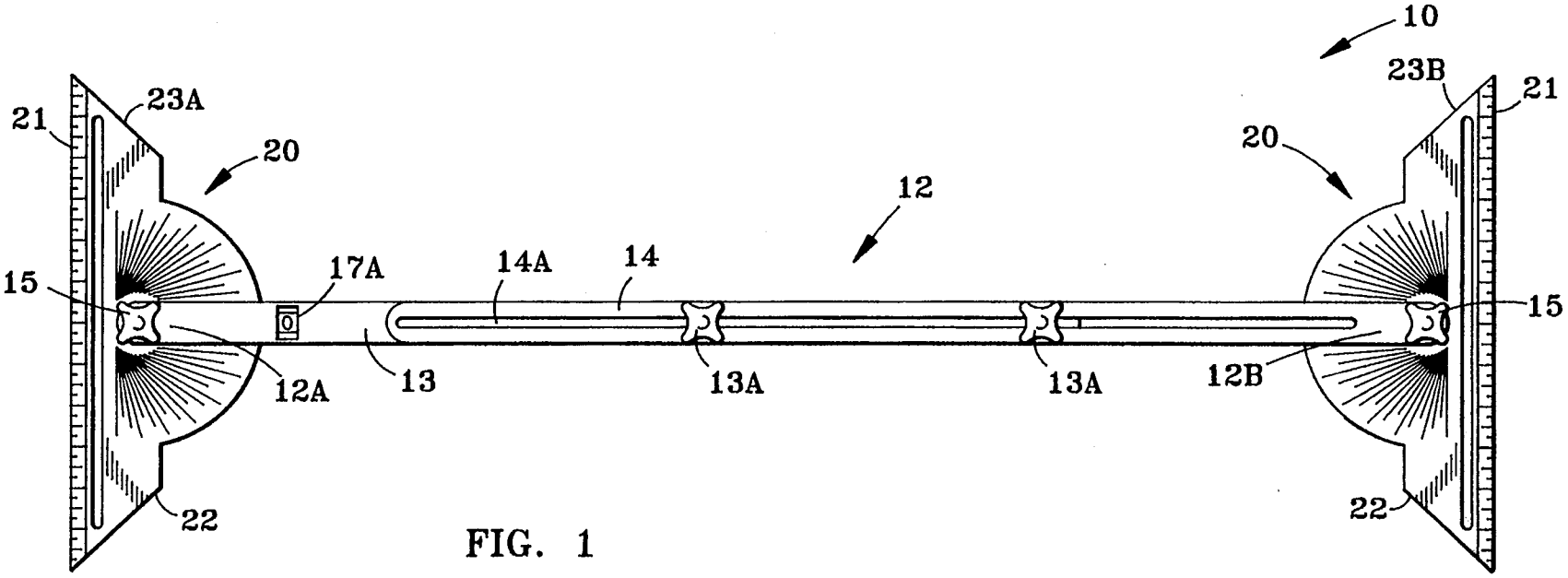
FIG. 1 is a top view of the improved versatile measuring device illustrating the rotatable protractor members rotated into a position such that the scribe edges of each protractor are parallel each to the other and orthogonal to the direction of the central extendible connecting member which i s extended to approximately one-half the total extendible length.
Figure 2:
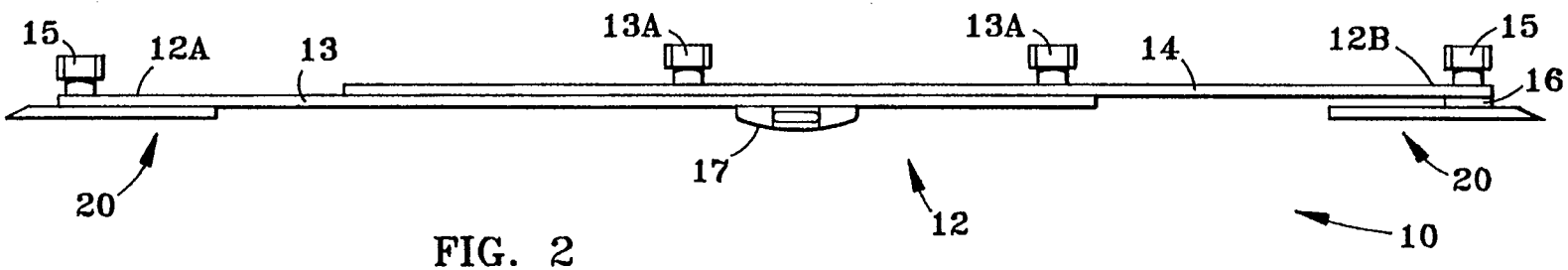
FIG. 2 is a side view of the improved versatile measuring device showing the relationship of the rotatable protractor members to the central extendible connecting member and illustrating the spacer component needed to offset the protractor connected to the extendible arm.
Figure 3:
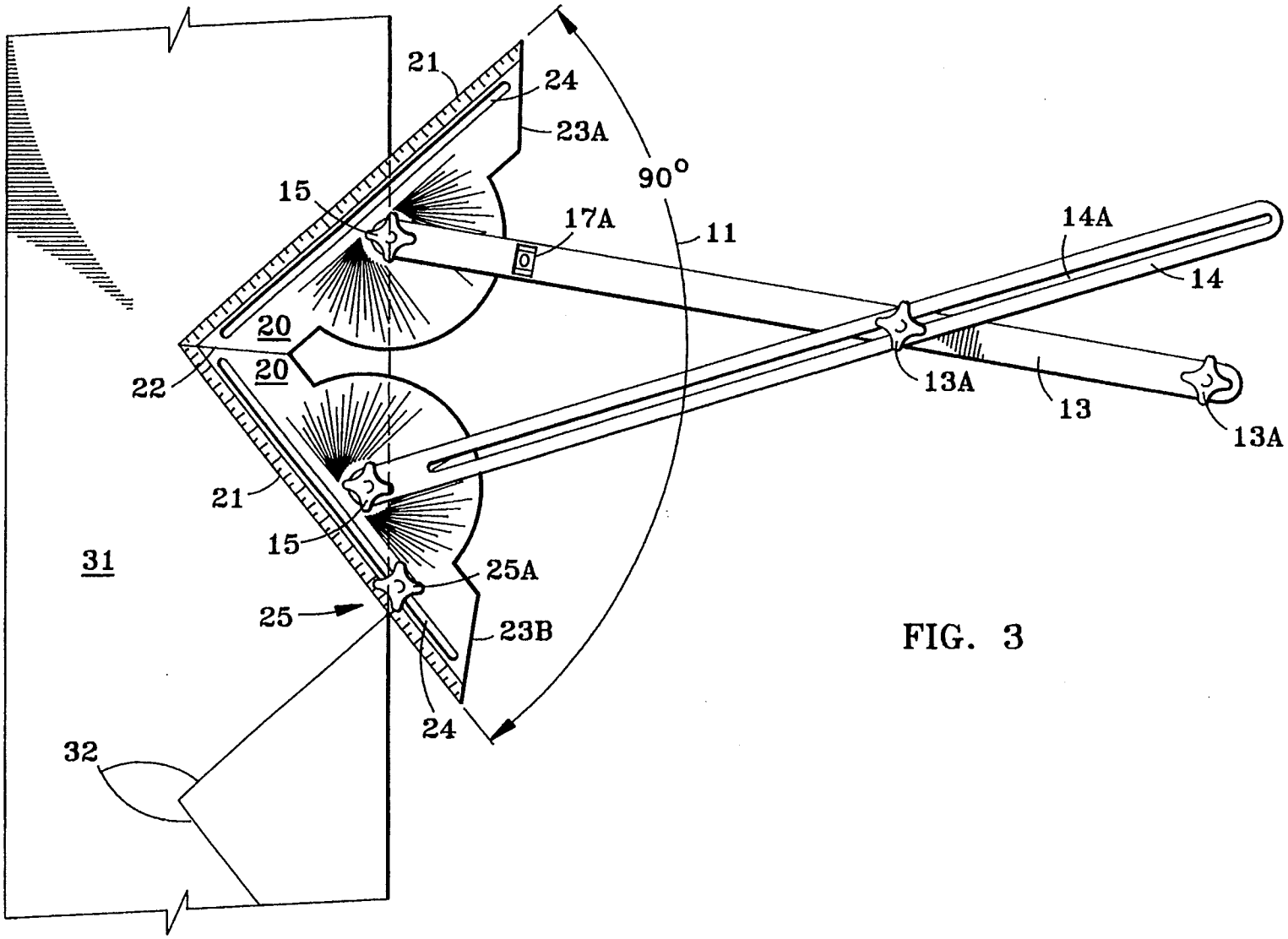
FIG. 3 is a is a top view of the improved versatile measuring device set up for use in scribing stair stringers.

Reference is now made to FIGS. 1–3 in order to describe one embodiment of improved versatile measuring device 10. One rotatable protractor member 20 is connected to protractor connection end 12A of main arm 13 of connecting member 12 and a second rotatable protractor member 20 is connected to protractor connection end 12B of extendible arm 14 of connecting member 12. The rotatable connections 12A and 12B are made using substantially identical locking mechanisms 15 shown as adjustable locking knobs 15. Bubble level 17A, used to measure plumb condition, is shown mounted at one end of main arm 13.

Connecting member 12 can be extended or shortened by loosening connecting member locking knobs 13A sufficient to permit extendible arm 14, having connecting member adjustment slot 14A, to slide in opposite directions relative to main arm 13. When the desired distance between protractor scribe edges 21 is obtained, locking knobs 13A are tightened. Linear scale marking 12C may be placed on adjacent surfaces of extendible arm 14 and main arm 13 providing a convenient measure of distance. Scale marking 12C may also be useful as a measure of the radius of an arc which could be scribed by fixing a center at either one of locking knobs 13A and mounting a scribe device at a selected position in edge-guide pin slot 24 which slot 24 is substantially parallel to scribe edge 21 of each protractor member 20.

In FIG. 2, the side view shows extendible arm 14 in relation to main arm 13 which are both attached by the locking arm knobs 13A. Locking arm knobs 13A may be loosened to allow the extension of the device. Protractor member 20 is connected to main arm 13 without a spacer, however protractor member 20 connected to extendible arm 14 has a spacer 16 to allow for the difference in height between arms 13 and 14. Means for measuring the degree of level on the horizontal, bubble level 17 i s illustrated as attached to main arm 13.

In FIG. 3, improved versatile measuring device 10 is being utilized as a tool to scribe lines 32 on stair stringer material 31 prior to cutting. The 90 degree scribe-edge angle 11 is created by removing one of the two locking arm knobs 13A is removed to allow the two protractor blades to be placed together. By adjusting the angle of protractor ends 20 in a manner which when 45 degree first protractor angle sides 22 are abutted a 90 degree angle is formed between each scribe edge 21 of each protractor 20. The height of the stair riser 7 and stair tread 8 can be adjusted using positionally adjustably edge-guide pin assemblies 25 held in place or locked using guide pin clamping knobs 25A. After setting scribe-edge angle 11 and the size of stairs are determined, scribed lines 32 may be drawn prior to cutting the stair stringer material 31.

It is clear to one of ordinary skill that the values of the angles at side edges 22 of protractors 20 could vary from for example 20 degrees to near 180 degrees as measured from scribe or linear scaled edge 21 of protractors 20 instead of them being equal in degree measure. Having one side edge 22, the same side edge 22 for each of two protractors 20, be 45 degrees permits the creation of a 90 degree angle between each of scribe edges 21 of protractors 20 when they are positioned with 45 degree angled side edges 22 butted together. Second fixed angle protractor side edges 23A and 23B are illustrated having about 45 degrees of angle but the intent here is to clearly suggest that these two side edges need not be equal to each other and need not be 45 degrees but may have degree measures which have advantages to application of the use of the device 10 to performing a particular task.

Figure 4:
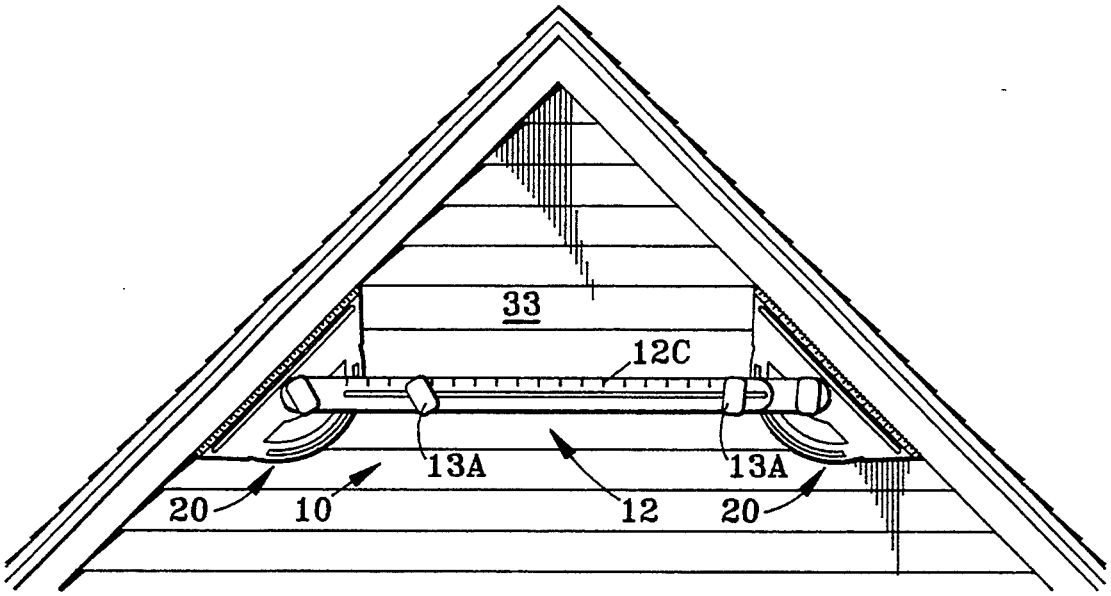
FIG. 4 is a front view of the improved versatile measuring device being utilized to form roofing gables.

In FIG. 4, improved versatile measuring device 10 is being used as a measuring and angling tool to construct a roof gable 33. Protractor members 20 are adjusted to form equal and opposite angles where as extendible arm 14 and main arm 13 are in a straight line on level which leveling may be accomplished using leveling means 17 and 17A (measuring of plumb) attachable to connecting member 12 and useful to measure both plumb and horizontal levelness.

Figure 5:
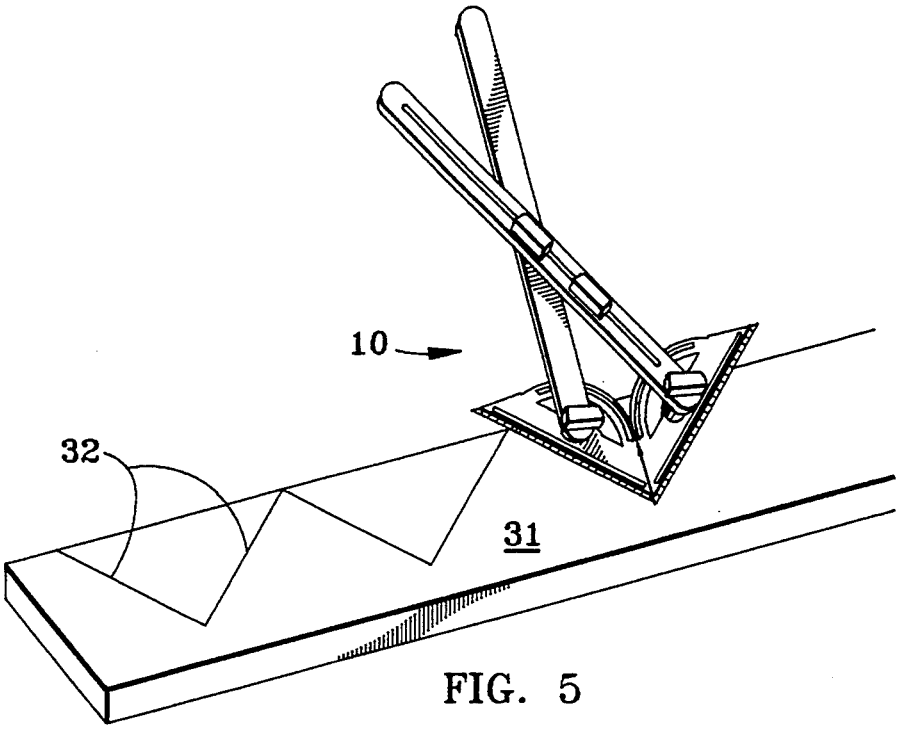
FIG. 5 is a perspective view of the improved versatile measuring device being used to scribe stair stringer material prior to cutting.
Figure 6:
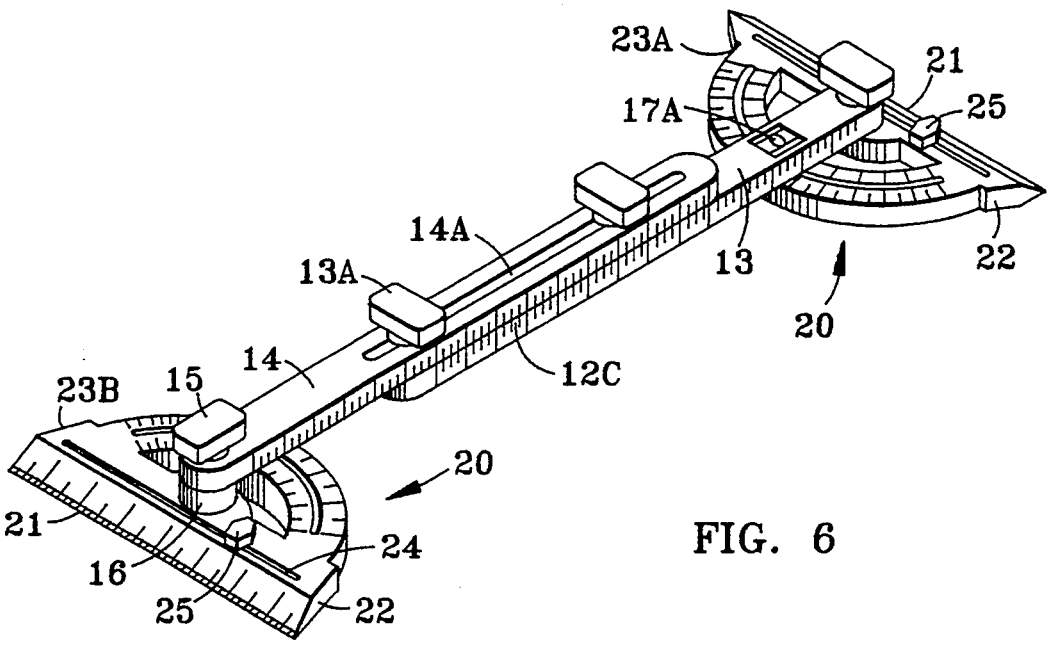
FIG. 6 is a perspective view of the improved versatile measuring device exhibiting the ruled or scale-marked connecting member as well as the protractor members.

In FIG. 5, improved versatile measuring device 10 is shown as used to scribe lines 32 on stair stringer material 31. In FIG. 6, one of each protractor member 20 is rotatably connected to extendible arm 14 at end 12B by the locking knob 15 and another protractor member 20 is rotatably connected to main arm 13 at end 12A by the locking knob 15. Protractor members 20 are illustrated as having a ruled or scaled scribe edge 21 which can be used in combination with connecting member 12 for measurement of distance and/or line lengths.

Figure 7:
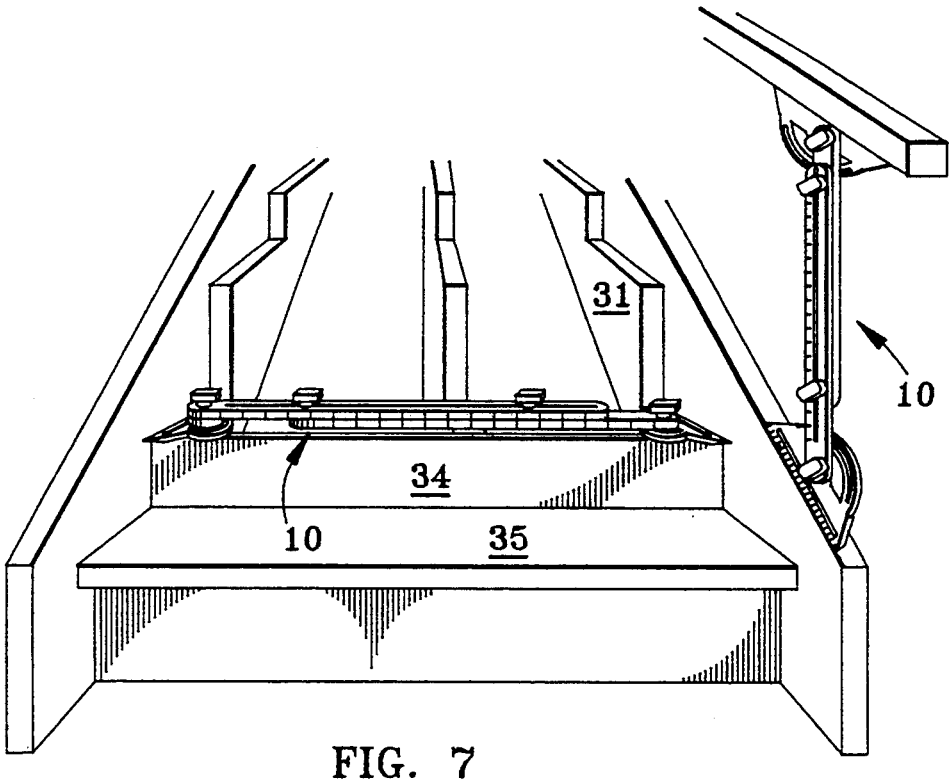
FIG. 7 is a perspective view of the improved versatile measuring device being utilized to measure the distance of the stair stringers prior to placement of the stair riser and tread and illustrating the use of the device in the placement of a railing.

In FIG. 7, improved versatile measuring device 10 is illustrated being used to maintain the distance between stair stringers 31 prior to the fastening of stair riser 34 or the stair tread 35. Improved versatile measuring device 10 has been extended to the proper width using adjustable locking knobs 13A.

It is thought that the present invention, the improved versatile measuring device and many of its attendant advantages is understood from the foregoing description and it will be apparent that various changes may be made in the form, construction an arrangement of the parts thereof without departing from the spirit and scope of the invention or sacrificing all of its material advantages, the form hereinbefore described being merely a preferred or exemplary embodiment thereof.

I claim:

1. A kit of components which when assembled is an improved versatile measuring device for measuring linear, and angular dimensions said kit of components comprising:

at least two protractor members each having a scribe edge;

at least one connecting member having a predetermined length and a first protractor connection end-being rotatably and clampably attachable to each said at least two protractor members and a second protractor connection end rotatably and clampably attachable to each said at least two protractor members at a protractor connection point;

means for linearly adjusting, to a preselected value, a distance between each said protractor connection points;

means for rotatably and clampably attaching each said at least two protractor members to said protractor connection points of said connecting member; and positionally adjustable edge-guide pins positionally securable within edge-guide pin slots defined by walls substantially parallel to each said scribe edge.

2. The kit of components according to claim 1 wherein said connecting member further comprises a main arm and an extendible arm and said means for linearly adjusting, to a preselected value, a distance between each said protractor connection point comprises an elongated wall defining a connecting member adjustment slot through said extendible arm, at least two pin assemblies for allowing a slideable relation between said main arm and said extendible arm and for making said main arm and said extendible arm lockingly interengagable when a predetermined distance between each said protractor connection point is determined.

3. The kit of components according to claim 2 further comprising means for removing all but one of said at least two pin assemblies thereby creating a pivoting point about which said main arm and said extendible arm of said connecting member are pivotable and clampable each with respect the other.

4. The kit of components according to claim 3 further comprising means for leveling and plumbing appropriately mountable on said connecting member.

5. An improved versatile measuring device for measuring linear, and angular dimensions comprising:

a connecting member comprising;

a main arm, an extendible arm having a slideable relation with said main arm, each said arm having a connecting member end, means for rotatably and clampably connecting a protractor member at a protractor connection point at each said connecting member end, and means for linearly adjusting, to a preselected value, a distance between each said protractor connection points which comprises;

an elongated wall defining a connecting member adjustment slot through said extendible arm, at least two pin assemblies for allowing said slideable relation between said main arm and said extendible arm and for lockingly interengaging said main arm and said extendible arm when a predetermined distance between each said protractor connection point is achieved, and means for removing all but one of said at least two pin assemblies thereby creating a pivoting point about which said main arm and said extendible arm of said connecting member are pivotable and clampable each with respect to the other;

at least two protractor members each having a scribe edge, at least one of said at least two protractor members being rotatably and clampably attached to each said protractor connection points of said connecting member; and means for adjustably positioning and securing an edge-guide pin at a predetermined position along said scribe edge of each said protractor members.

6. The improved versatile measuring device according to claim 5 wherein said means for adjustably positioning and securing an edge-guide pin at a predetermined position along said scribe edge of each said protractor members is an edge-guide pin slot defined by walls substantially parallel to each said scribe edge.

7. The improved versatile measuring device according to claim 5 wherein said at least two protractor members each further comprises at least one side edge having an angle of 45 degrees from said scribe edge of said protractor members.

8. The improved versatile measuring device according to claim 6 wherein said at least two protractor members each further comprises at least one side edge having an angle of 45 degrees from said scribe edge of said protractor members.

9. The improved versatile measuring device according to claim 5 wherein said connecting member further comprises a leveling means operative to measure level in a horizontal and a vertical plane.

10. The improved versatile measuring device according to claim 6 wherein said connecting member further comprises a leveling means operative to measure level in a horizontal and a vertical plane.

11. The improved versatile measuring device according to claim 7 wherein said connecting member further comprises a leveling means operative to measure level in a horizontal and a vertical plane.

12. The improved versatile measuring device according to claim 8 wherein said connecting member further comprises a leveling means operative to measure level in a horizontal and a vertical plane.

* * * * *